US005577601A

United States Patent [19]

Chung et al.

[11] Patent Number: 5,577,601

[45] Date of Patent: Nov. 26, 1996

[54] ACTUATING DEVICE FOR A MONITOR POWER SWITCH

[75] Inventors: Dae-il Chung; Sung-gil Cha, both of Suwon, Rep. of Korea

[73] Assignee: Samsung Electronics Co., Ltd., Kyungki-do, Rep. of Korea

[21] Appl. No.: 453,523

[22] Filed: May 30, 1995

[30] Foreign Application Priority Data

May 30, 1994 [KR] Rep. of Korea ..... 94-12094
Sep. 6, 1994 [KR] Rep. of Korea ..... 94-22877

[51] Int. Cl.[6] ..... H01H 3/20

[52] U.S. Cl. ..... 200/331; 200/330; 200/341; 200/292; 74/503

[58] Field of Search ..... 200/331, 330, 200/329, 337, 341, 520, 537, 538, 292; 74/503

[56] References Cited

U.S. PATENT DOCUMENTS

| | | | |
|---|---|---|---|
| 3,978,304 | 8/1976 | Salvati et al. | 200/331 |
| 4,011,423 | 3/1977 | Zepp | 200/337 |
| 4,295,026 | 10/1981 | Williams et al. | 200/331 |
| 5,345,051 | 9/1994 | Miike | 200/341 |

*Primary Examiner*—David J. Walczak
*Attorney, Agent, or Firm*—Banner & Allegretti, Ltd.

[57] ABSTRACT

The present invention is directed to an actuating device for a power switch of a monitor, in which an actuator member for activating the power switch is slidably coupled either internally or externally, to a supporting plate of a frame which holds a printed circuit board. The coupling of the actuating device to the supporting plate of the frame holds the actuating device in alignment independent of the printed circuit board.

20 Claims, 6 Drawing Sheets

ACTUATING DEVICE FOR A MONITOR POWER SWITCH

BACKGROUND OF THE INVENTION

The present invention relates to a device for actuating a power supply switch mounted on a printed circuit board within a monitor case, and more particularly, to an improved actuating device which precisely actuates a monitor power supply switch and simultaneously prevents a cathode ray tube from being influenced by electromagnetic energy.

A power switch is generally installed on a printed circuit board within a monitor and is activated, i.e., turned on and off, by a button installed on the front case of the monitor. The power switch is located a substantial distance from the button. The power switch thus must be activated by a pushing force that is transmitted from the button to the switch through the medium of an actuator member.

An embodiment of a conventional configuration as described above is schematically illustrated in FIGS. 1A and 1B. As seen in these Figures, a printed circuit board 10 is inserted into and affixed within rail groves 202 of guide rails 201 installed on a chassis frame 200. A power switch 11 is mounted on printed circuit board 10.

An actuator member in the form of an elongated pole 300 is used to activate power switch 11. One end of pole 300 contacts the input device of power switch 11 and extends through guide holes 13 of radiators 12 that are mounted on printed circuit board 10. A stopper 301 is integrally formed on pole 300.

A button 40 is installed on the front side of a front case 1 of a monitor. A pushing force applied to button 40 is transferred to power switch 11 via elongated pole 300, and button 40 is returned to its rest position by a spring 41.

The described power switch actuating mechanism has a number of drawbacks. For example, the radiation efficiency of the radiators drops because the apertures in the radiators reduces the radiating area. Also, since the elongated pole extends through the apertures in the radiators, the weight bearing on the printed circuit board is increased.

Furthermore, this actuating mechanism does not make efficient use of space on a circuit board and results in increased production cost because precise processing and assembly are required, thereby complicating the process for chassis frame assembly.

SUMMARY OF THE INVENTION

It is therefore an object of the present invention to provide an actuating device for a power switch mounted on a printed circuit board, wherein an actuator member is securely installed without using components of the printed circuit board, and still enabling the space interval to meet with safety regulations.

It is also an object of the invention to make efficient use of the space on the circuit board and to enlarge the radiating area of a radiator, thereby enhancing the efficiency of the radiant heat dissipated from a circuit board.

It is another object of the invention to provide a power switch actuating device that simplifies the assembly and manufacturing process, thereby saving production costs.

To accomplish the object of the present invention, the actuating device is characterized in that first and second guide openings are formed in of a frame to which a printed circuit board is fixed. An actuator member is installed in such a manner that alignment projections extend from the actuator member and are slidably fitted through the first and second guide openings. The actuator member is thus allowed to move back and forth along the supporting plate of the frame, and is held in alignment with the supporting plate by the sliding engagement of the alignment members within the guide openings.

The novel features believed characteristic of the present invention are set forth in the appended claims. The invention itself, however, as well as other features and advantages thereof, will be best understood by reference to the detailed description which follows, read in conjunction with the accompanying drawings.

DETAILED DESCRIPTION OF PREFERRED EMBODIMENTS

FIGS. 2, 3, 4 and 5 illustrate the first embodiment of the present invention.

Figure 1A:
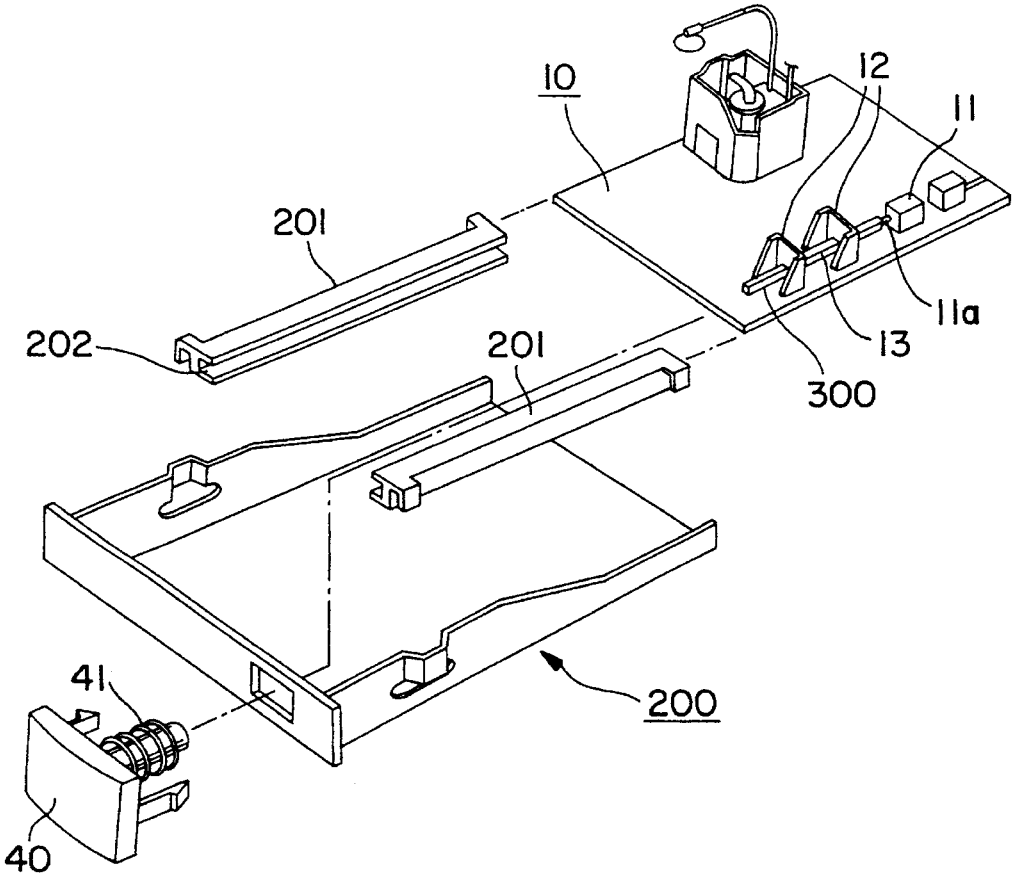
FIG. 1(A) (PRIOR ART)
FIGS. 1A and 1B are, respectively, an exploded perspective view and a cross-sectional view of a conventional power supply switch actuating device.
Figure 1B:
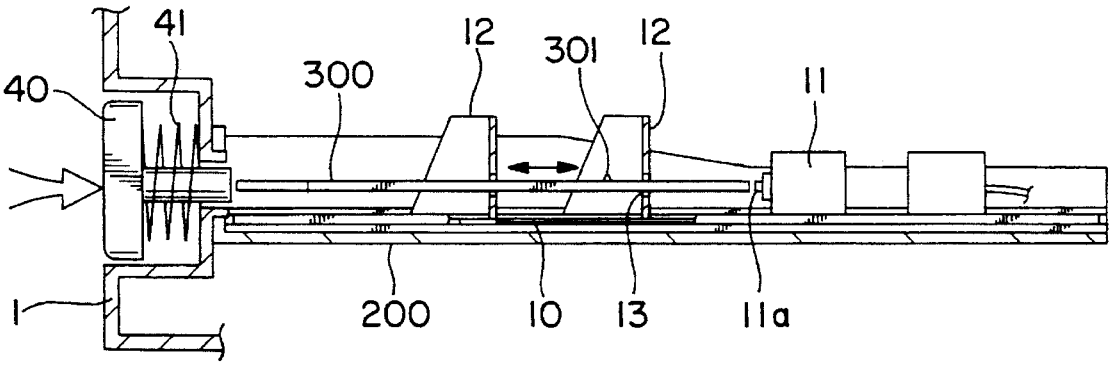
FIG. 1(B) (PRIOR ART)
Figure 2:
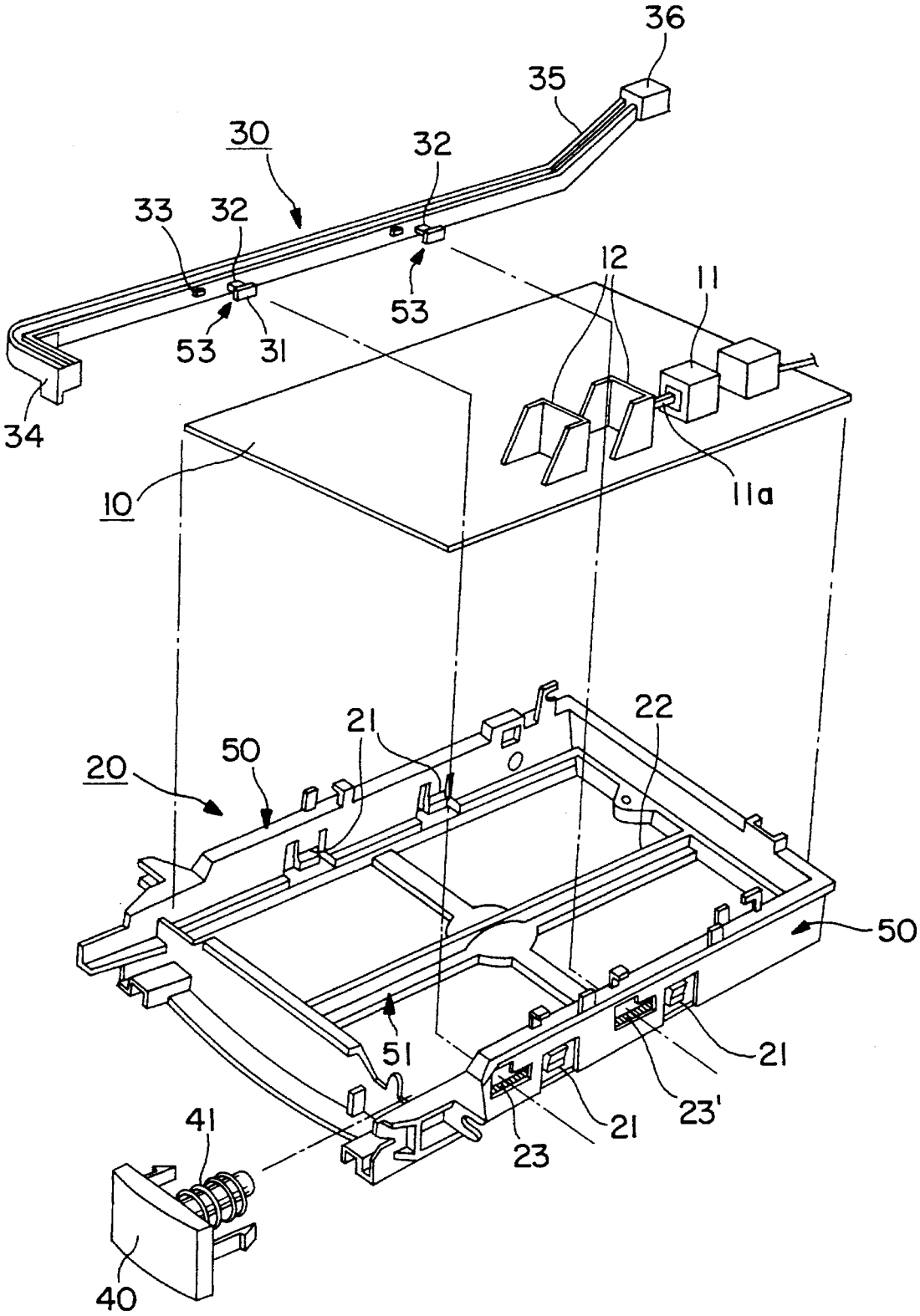
FIG. 2 is an exploded perspective view of a first preferred embodiment of an actuating device for a monitor power switch in accordance with the present invention.

Referring to FIG. 2, an actuating device for a power switch of a monitor according to the present invention is illustrated. A power switch 11 is mounted on the rear section of a printed circuit board 10. Other electronic components are also mounted on the printed circuit board. A button 40 is installed on a front case 1 of a monitor in general alignment with power switch 11. A spring 41 provides a restoring force on button 40. The printed circuit board is removably affixed to a frame 20, which is preferably molded.

A pair of snaps 21 of predetermined elasticity are integrally formed on each side wall of frame 20. A protrusion 22 to prevent sagging of the circuit board 10 due to the weight of electronic components is formed on a cross member 51 extending between the front and back of frame 20.

First and second guide openings and change "one of the side walls " to 23 and 23' are formed in one of the side walls 50 of frame 20 at a predetermined interval between one another along the length of supporting plate 50. Supporting plate 50 is preferably one of the side walls of frame 20. Each hole includes an assembly hole 23*a* and a slide groove 23*b*.

An actuator member 30 is formed as a longitudinally extending bar or rod that extends from button 40 to switch 11. A pair of alignment projections 53 extend laterally from the side of actuator member 30.

Figure 3A:
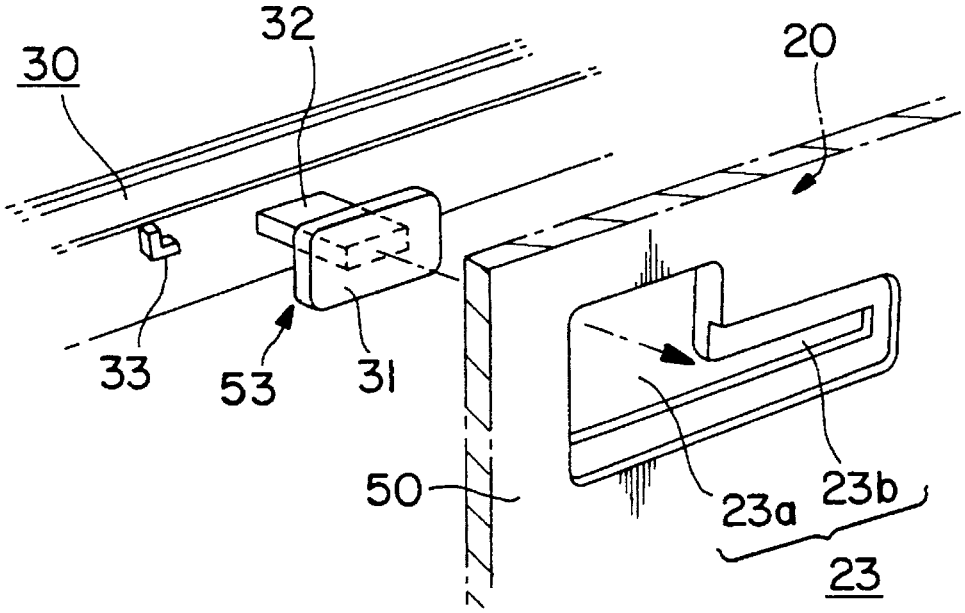
FIG. 3A is an exploded perspective partial view of the actuating device of FIG. 2.
Figure 3B:
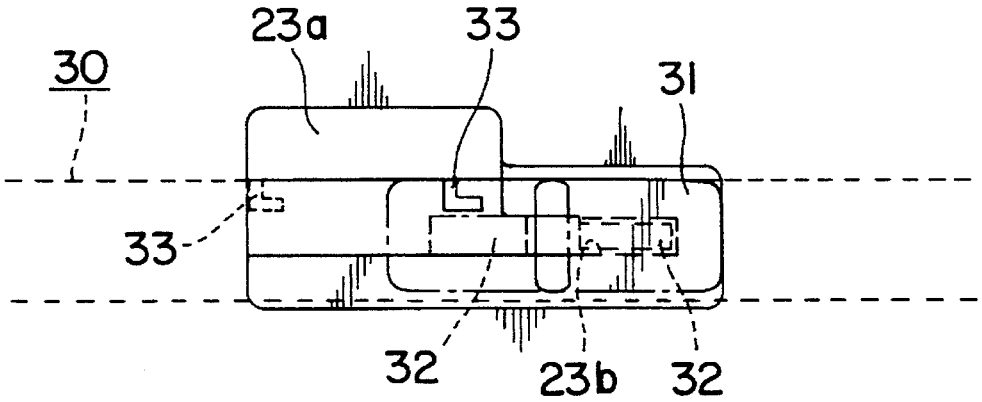
FIG. 3B is a front partial view illustrating alternate positions of the actuating device of FIG. 2.
Figure 4:
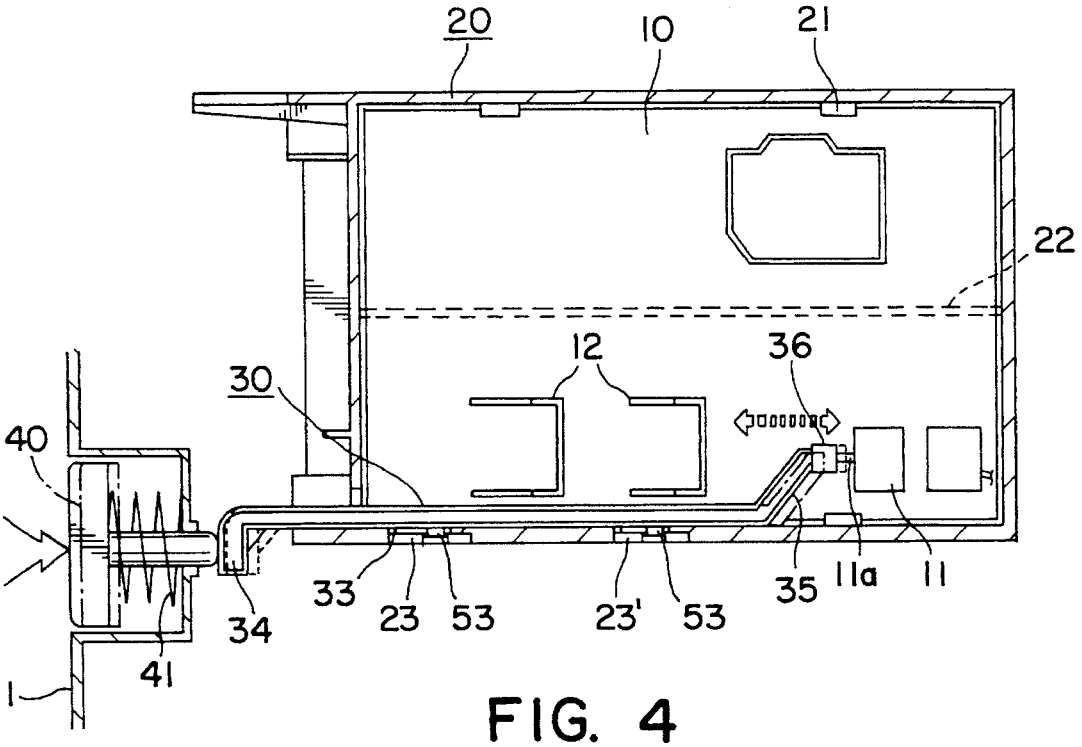
FIG. 4 is a top plan view illustrating alternate positions of the actuating device of the first embodiment.

Each alignment projection 53 includes a first section in the form of a flat guide plate 32 that extends generally perpendicularly from the side of actuator member 30, and a second section in the form of a guide tab 31 that extends generally perpendicularly from the outer end of flat plate 32. As seen in FIGS. 3A and 3B, each alignment projection 53 is coupled to the side wall 40 by passing guide tab 31, which functions as an enlarged head, through an assembly hole 23*a* and sliding flat plate 32 at least partially into slide groove 23*b*. A stop 33 also extends from the side of actuator member 30 adjacent at least one of the alignment projections 53, and functions as an end stop to hold flat plate 32 within slide groove 23*b*, as shown by the phantom line position in FIG. 3B.

The actuator member 30 also includes first and second contact surfaces 34 and 36 at its opposite ends for contacting button 40 and switch 11. At one end, contact surface 34 is formed as a bent end of actuator member 30. The opposite end of actuator member 30 includes a slanted section 35 bent inwardly toward switch 11. Contact surface 36 is formed as a block at the distal end of slanted section 35.

A circuit board 10 is preferably inserted into frame 20, and is securely fixed to frame 20 by snaps 21. The bottom of the circuit board 10 is supported by protrusion 22 of frame 20 so that sagging of the circuit board 10 due to the weight of electronic components is prevented.

After each alignment projection 53 is inserted into corresponding first and second guide openings 23 and 23' and each flat guide plate 32 is located in a respective slide groove 23*b*, then the guide plates travel in a rectilineal motion guided by slide groove 23*b*, to thereby hold actuator member 30 in alignment with frame 20 along two axes or directions. That is, actuator member 30 is held in alignment along an axis parallel to its length and an axis perpendicular to its length in an up and down direction. Also, since the dimension of guide tab 31 is broader than that of sliding groove 23*b* and since guide tab 31 has an inwardly facing guide surface that slides along a side surface of supporting plate 50 on a side opposite to actuator member 30, the actuator member 30 is held in alignment along a third axis generally perpendicular to supporting plate 50.

Once an actuator 30 is assembled and fixed to frame 20 in such a manner, then the first contact surface 34 of the actuator 30 is aligned and kept in touch with button 40, and second contact surface 36 remains in a condition of contact with an input rod 11*a* of power switch 11. As best seen in FIG. 2, actuator member 30 is slidably disposed in substantially parallel, linear relation to said supporting plate 50.

As a result, when button 40 installed into a frame case 1 is pushed, then the pressure applied onto button 40 is transferred to actuator 30, thereby actuating the switching operation of power switch 11.

Figure 5:
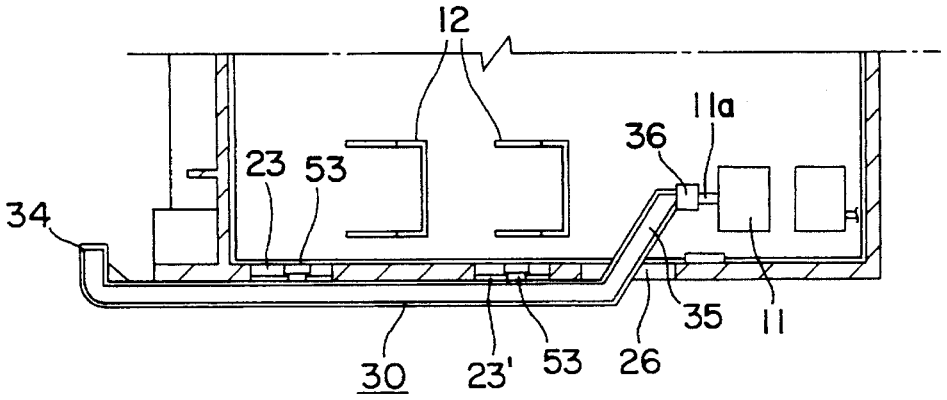
FIG. 5 is a partial top plan view illustrating another embodiment of the actuator device of the type illustrated in FIG. 2.

A modified version of the first embodiment of the present invention is illustrated in FIG. 5. This version is the same as the embodiment in FIGS. 2–4, except that most of the length of actuator member 30 is disposed external of frame 20. To this end, an aperture hole 26 is formed on a section of frame 20 through which slanted section 35 extends to locate second contact surface next to switch 11.

Figure 6A:
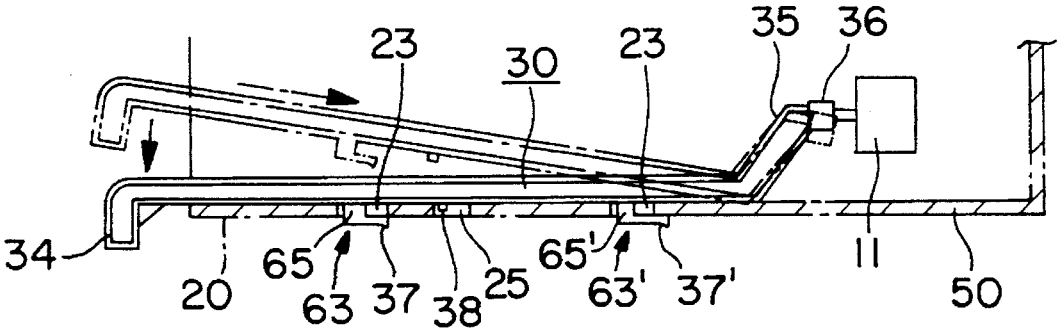
FIGS. 6A and 6B are schematic partial top plan views, illustrating two versions of a second embodiment of the present invention.
Figure 6B:
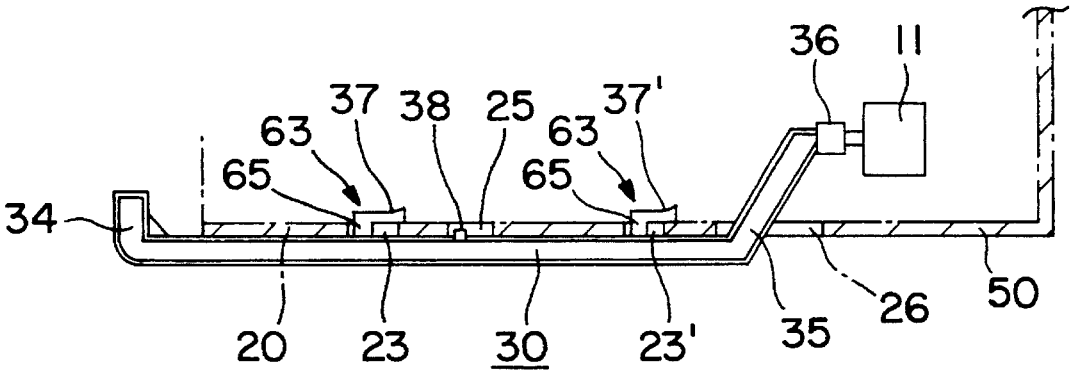

FIGS. 6A and 6B illustrate a second preferred embodiment of the present invention wherein L-shaped alignment projections 63 and 63' of predetermined elasticity are formed on, and extended from, one side of actuator member 30. Alignment projections 63 and 63' each have a first base section 65, 65' that extends from the side of actuator member 30 toward supporting plate 50, and a second guide section 37, 37' extending from an end of the base section. Base sections 65, 65' function as the guide plates 32 of the first embodiment, and guide sections 37, 37' function as the guide tabs 31 of the first embodiment. Guide section 37' is formed longer than guide section 37.

A stop hole 25 for limiting operation of actuator member 30 is formed in a section of frame 20 in between the first and second guide openings 23 and 23'. A stop 38 protrudes from one side of actuator member 30 and extends into stop hole 25 to limit the motion of actuator member 30.

In assembling of the actuator member of the above the second embodiment, longer guide section 37' is inserted at a tilt angle and increasingly pushed into section guide opening 23' as shown in phantom lines in FIG. 6A. The elastic force of L-shaped alignment projection 63' forces it into second guide opening 23'.

Thereafter, once the length of first guide opening 23 is aligned with that of L-shaped alignment projection 63, then the actuator member 30 is pushed forwardly and the two alignment projections 63 and 63' are slidingly held in first or second guide openings 23 and 23'. Stop 38 is also flexibly inserted into stop hole 25 by pushing power applied to actuator member 30.

In the configuration of the second embodiment of the present invention, actuator member 30 may be assembled on either side of the supporting plate 50 of frame 20 as shown in FIGS. 6A and 6B. FIG. 6A illustrates actuator member internal of supporting plate 50, while FIG. 6B illustrates actuator member external of supporting plate 50.

Figure 7:
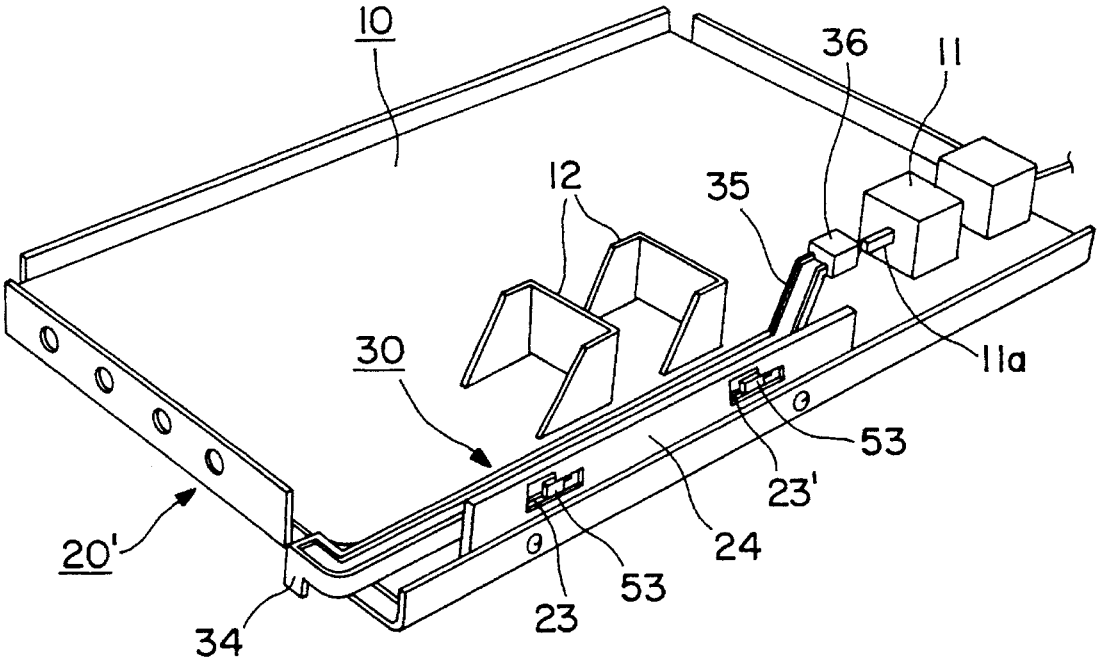
FIG. 7 is a perspective view of a third embodiment of monitor power switch actuating device of the present invention.

Referring to FIG. 7, a third preferred embodiment is disclosed. In this particular embodiment, a supporting member 24, having first and second guide openings 23 and 23' is affixed to frame 20'. The actuator member 30 is sliding secured to frame 20' by inserting alignment projections 53 into corresponding guide openings 23 and 23'. Alignment projections 53 are formed as in the first embodiment with sections 31 and 32.

As described above, the power switch actuating device according to the present invention, is affixed and assembled without adding any particular components to an existing device on the circuit board, yet still ensures a space interval between the on-off button and the power switch of the monitor, as required for safety.

Further, radiant heat is efficiently dissipated from a printed circuit board through a radiator with an enlarged radiation area, since space on the radiator is not taken up with an alignment hole for the actuator member. Thus, prevention of malfunction of the circuit board is enhanced.

Although this invention has been described in its preferred form with a certain degree of particularity, it is understood that the present disclosure of the preferred form has been made only by way of example. Numerous changes in the details of construction and the combination and arrangement of parts may be used, as well as the combination of functions within or as part of other devices, without departing from the spirit and scope of the invention as hereinafter claimed.

We claim:

1. An actuating device for activating a power switch provided on a circuit board which is mounted on a frame in a monitor, said actuating device comprising;

a push button installed externally of the frame;

first and second guide openings formed in spaced relation along a supporting plate of said frame; and an actuator member slidably disposed on one side of said supporting plate and having a first end disposed adjacent said push button and a second end disposed adjacent said switch for activating the switch in response to pressure applied to said push button, and a pair of alignment projections extending from said actuator member and being movably engaged within said first and second guide openings for holding said actuator member in alignment along said supporting plate of said frame.

2. The actuating device as claimed in claim 1, wherein said first and second guide openings include an assembly hole and a slide groove defining a width, and each alignment projection includes a plate extending from said actuator member and a guide tab extending from an end of said plate in a direction generally parallel to said side wall of said frame, wherein said plate is slidably received in said slide groove and said guide tab has a guide surface larger than the width of said slide groove.

3. The actuating device as claimed in claim 2, wherein said actuator member extends internally of said supporting plate of said frame.

4. The actuating device as claimed in claim 2, wherein said actuator member extends externally of said supporting plate of said frame.

5. The actuating device as claimed in claim 2, wherein said assembly hole is sized to allow the passage of said guide tab.

6. The actuating apparatus as claimed in claim 1, wherein a stop extends from said actuator member adjacent at least one of said alignment projections and into one of said guide openings for limiting a linear moving distance of said actuator member.

7. The actuating device as claimed in claim 1, wherein said actuator member extends externally of said supporting plate of said frame.

8. The actuating device as claimed in claim 1, wherein said actuator member extends internally of said supporting plate of said frame.

9. The actuating device as claimed in claim 1, wherein each alignment projection is formed as an L-shaped member having a base extending from said actuator member and an end section extending perpendicularly from said base, each said base being slidably carried in a respective one of said guide openings and each said end section being in sliding engagement with a side of said supporting plate.

10. The actuating device as claimed in claim 9, wherein said actuator member extends internally of said supporting plate of said frame.

11. The actuating device as claimed in claim 9, wherein said actuator member extends externally of said supporting plate of said frame.

12. The actuating device as claimed in claim 9, including a stop formed on said actuator member and extending into a stop hole formed at a location between said first and second guide openings in order to limit a linear moving distance of said actuator member.

13. The actuating device as claimed in claim 1, wherein said supporting plate is formed by a separate supporting member attached to one side of said frame.

14. The actuating device as claimed in claim 1, wherein said actuator member includes a first contact surface integrally formed on a front portion of said actuator member, a slanted section formed in a rear portion and a second contact surface at an end of said slanted section, wherein said first contact surface is adapted to contact said push button of the monitor and said second contact surface is adapted to contact an input portion of the power switch.

15. An actuating device for activating a power switch of a monitor, wherein the power switch and a printed circuit board are mounted on a frame, said actuating device comprising:

first and second guide openings formed in a supporting plate of said frame, said first and second guide openings being spaced from one another along a length of said supporting plate;

an actuator member for coupling the switch to an activation area external of the monitor and activating the switch by a linear motion of the actuator member, said actuator member having a first end proximate said external activation area and a second end proximate the switch, said actuator member extending adjacent to and along the length of a first side of said supporting plate; and first and second alignment projections extending from said actuator member toward said supporting plate, each alignment projection including a first section extending into a respective one of said first and second guide openings, said first and second alignment projections being coupled to said first and second guide openings in a manner to hold said actuator member in alignment with said supporting plate during the back and forth motion of said actuator member.

16. The actuating device as claimed in claim 15, wherein said first and second alignment projections each include a second section extending from said first section and generally parallel to said supporting plate, each second section having a guide surface facing a second side of said supporting plate opposite said first side, wherein sliding motion of said first sections within said first and second guide openings holds said actuator member in alignment along first and second axes and sliding motion of said second sections along said second side of said supporting plate holds said actuator member in alignment along a third axis.

17. The actuating device of claim 16, wherein each said second section is formed as an enlarged head at the end of said first section, and each said guide opening is formed with an enlarged assembly area through which said enlarged head passes and a guide slot along which said first section slides.

18. The actuating device of claim 16, wherein the first and second sections of each alignment projection is formed in an L-shaped configuration.

19. An actuating device for activating a power switch of a monitor, said actuating device comprising;

a frame for supporting a circuit board and the power switch, said frame having a supporting plate integral with one side wall;

first and second guide openings formed in said supporting plate, said first and second guide openings including an assembly hole and a slide groove defining a width; and an actuator member for activating the switch, and a pair of alignment projections extending from said actuator member and being movably engaged within said first and second guide openings for holding said actuator member in alignment along said supporting plate, each alignment projection including a plate extending from said actuator member and a guide tab extending from an end of said plate in a direction generally parallel to said supporting member, wherein said plate is slidably received in said slide groove and said guide tab has a guide surface larger than the width of said slide groove.

20. An actuating device for activating a power switch of a monitor, wherein the power switch and a printed circuit board are mounted on a frame, said actuating device comprising:

a frame for holding the switch and the printed circuit board, said frame including a supporting plate integral with one side wall;

first and second guide openings formed in said supporting plate, said first and second guide openings being spaced from one another along the length of said supporting plate;

an actuator member for coupling the switch to an activation area external of the monitor and activating the switch by back and forth motion of the actuator member, said actuator member extending adjacent to and along a length of a first side surface of said supporting plate; and first and second alignment projections extending from said actuator member toward said supporting plate, each alignment projection including a first section extending into a respective one of said first and second guide openings, said first and second alignment projections being coupled to said first and second guide openings in a manner to hold said actuator member in alignment with said supporting plate during the back and forth motion of said actuator member, a second section extending from said first section and generally parallel to said supporting plate, each second section having a guide surface facing a second side of said supporting plate opposite said first side surface, wherein sliding motion of said first sections within said first and second guide openings hold said actuator member in alignment along first and second axes and sliding motion of said second sections along said supporting plate holds said actuator member in alignment along a third axis.

* * * * *